US005395184A

United States Patent [19]

Gagliano

[11] Patent Number: 5,395,184

[45] Date of Patent: Mar. 7, 1995

[54] STRUCTURE LOAD TRANSFER SYSTEMS

[76] Inventor: Richard J. Gagliano, 5004 Puget Blvd., SW., Seattle, Wash. 98106

[21] Appl. No.: 11,370

[22] Filed: Jan. 29, 1993

[51] Int. Cl.[6] ..... E02D 5/00

[52] U.S. Cl. ..... 405/229; 52/158; 405/232

[58] Field of Search ..... 405/227, 229, 230, 232; 52/146, 152, 155, 158

[56] References Cited

U.S. PATENT DOCUMENTS

| | | | |
|---|---|---|---|
| 1,334,053 | 3/1920 | Reynolds | 52/152 |
| 1,808,633 | 6/1931 | Carver | 52/158 |
| 2,001,719 | 5/1935 | Greene | 52/158 |
| 2,826,281 | 3/1958 | Johnson | 52/158 |
| 3,216,159 | 11/1965 | Rooker | 52/158 |
| 3,524,322 | 8/1970 | Pogonowski | 405/227 |
| 3,572,044 | 3/1971 | Pogonowski | 405/227 X |
| 4,706,921 | 11/1987 | Paulin | 52/158 X |
| 5,011,336 | 4/1991 | Hamilton et al. | 405/230 |
| 5,145,291 | 9/1992 | Bullivant | 405/230 |

*Primary Examiner*—David H. Corbin

*Attorney, Agent, or Firm*—Hopgood, Calimafde, Kalil & Judlowe

[57] ABSTRACT

Low environmental impact, surface installed, load transfer systems providing stable connection between above ground structures and the earth, having a plurality of offset driving holes in an integral structure member, or in a bracket or brackets attachable to such a structure, through which piles may be driven into the surrounding soil to create, in differing configurations, the necessary resistances to any combination or relative proportions of the bearing, uplift and lateral loads associated with such structures. The piles are driven at predetermined angles relative to the supported structure, and consistent with its loading characteristics, and bind under load against the offset driving holes through which they pass.

9 Claims, 5 Drawing Sheets

FIG. 2
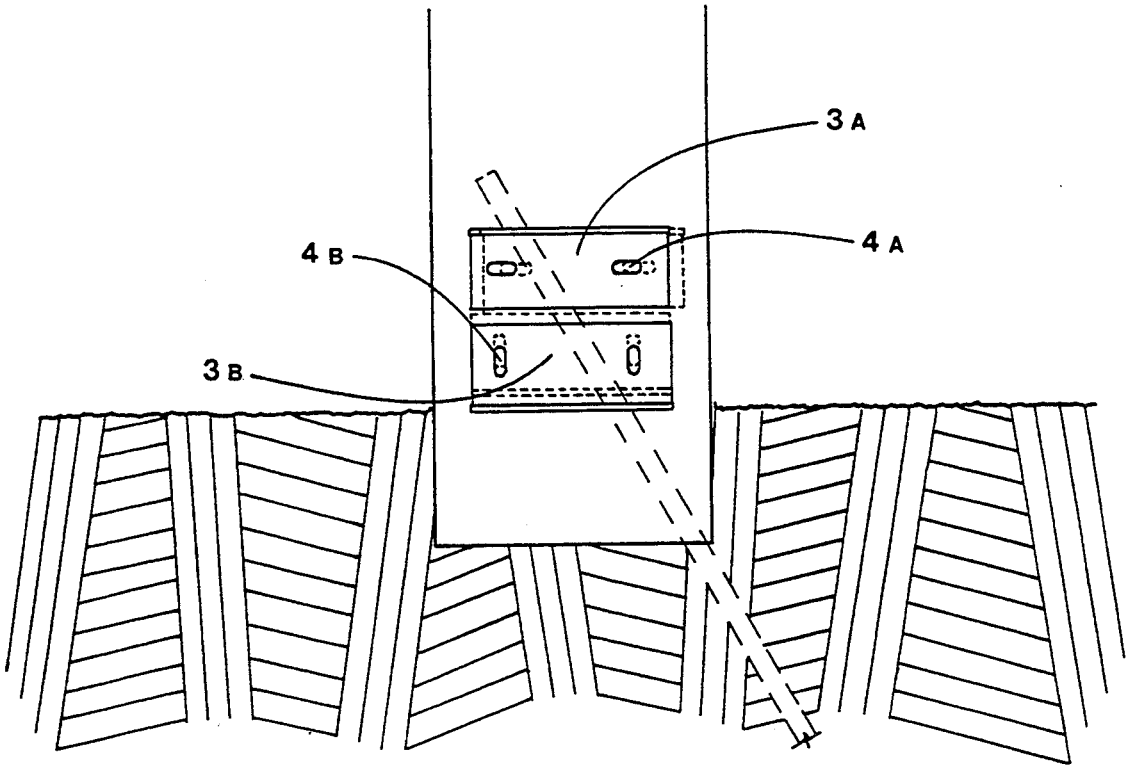
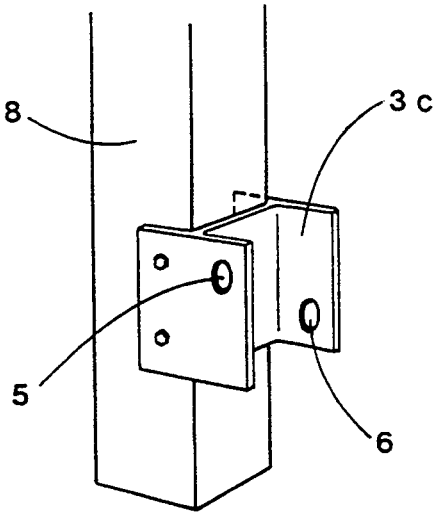
FIG. 3
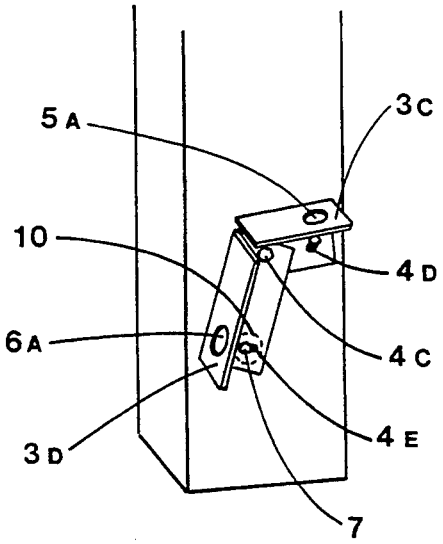
FIG. 4

STRUCTURE LOAD TRANSFER SYSTEMS

The present invention relates to an integrated load transfer system for surface structures. More specifically, the present invention relates to the application of one or more engineered brackets having specifically delineated openings for receiving complementing elongated piles at oblique angles relative to a bearing load forming a transfer system capable of transferring to the earth, surface loads comprised of bearing, lateral, and uplift forces.

BACKGROUND OF THE INVENTION

The search for less expensive, more effective, and more environmentally sound methods of creating building foundations for new construction on previously undisturbed or undesirable building sites has led to the development by the applicant of the Pinned Foundation System. (See, U.S. Pat. No. 5,039,256 incorporated herein by reference.) These systems are an important advance in foundation engineering and have expanded the availability of select sites for surface structures.

Most foundation systems used in significant structure support require meaningful amounts of cement or concrete. The use of concrete or other cementitious material is often an unattractive option for a growing number of building sites. These sites are invariably inaccessible to concrete trucks and pumping systems. Indeed, to the environmentally conscious, concrete itself is comprised of non-renewable resources which are expensively produced and demand environmentally destructive methods of extraction.

A variety of structure to earth, load transferring systems, which do not rely on a cementitious material, have been developed including U.S. Pat. Nos. 1,808,633 and 2,964,145. (See, also, U.S. Pat. Nos. 2,826,281, 5,039,256, 1,783,713, 2,221,325 and 2,815,778). The significant drawback of these systems is that they are primarily limited to one or another of the three types of loads-bearing, lateral and uplift, and lack the versatility needed to address significant structure support.

In addition to eliminating the need for cementitious material in significant structure foundations, it is also desirable that the types and possible combinations of loads is increased, and the range of possible surface structures to which these systems can be applied is widened. The present invention was developed to fulfill these objectives.

OBJECTS AND SUMMARY OF THE PRESENT INVENTION

An object of this invention is to expand on a method for constructing a structure to earth load transferring system, which is applicable to a wide variety of site and soil conditions, and a wide variety of surface structures.

Another object of this invention is to provide a versatile transfer system which can be easily adapted for use with a variety of construction methods.

Another object of this invention is to provide a transfer system which is applicable for a wide variety of distributed load conditions, including distributed and concentrated loading.

It is also an object of this invention to provide a transfer system which is adaptable to varying combinations and proportions of bearing, lateral, and uplift loads.

A further object of this invention is to provide a transfer system which is resilient to a degree of prolonged and/or sudden soil movement.

A further object of this invention is to provide a transfer system which reinforces the soil which it engages.

A further object of this invention is to provide a transfer system which requires the use of substantially less non-renewable resources than current methods.

A further object of this invention is to provide a method for constructing a transfer system which will require substantially less site excavation, drainage control, and soil backfill for above-grade structures.

A further object of this invention is to provide a method for constructing a transfer system which causes substantially less erosion than current methods.

A further object of this invention is to provide a method of constructing a transfer system without significantly damaging or altering the moisture content, drainage characteristics, chemical/molecular composition or structural integrity of the soil which it engages.

A further object of this invention is to provide a transfer system which can be installed on flat or sloping sites without altering the existing grade.

A further object of this invention is to provide a transfer system which can be installed either with simple manual tools, or light duty mechanical tools.

It is also an object of this invention to provide a transfer system which is removable and reusable, and has replaceable parts.

It is also an object of this invention to provide a series of embodiments of a transfer system which can be applied repeatedly as standardized construction components with a specific load capacity, load type, maintenance schedule and structural function.

It is also an object of this invention to provide a driven pile based transfer system, where the piles are of a specifically delineated length.

It is also an object of this invention to provide a transfer system where increase in loading increases the efficiency of the transfer of loads.

It is a further object of this invention to provide a transfer system which has a locking function which in some cases may be adjusted for differing loading and/or structure performance criteria.

The above and other objects of the present invention are realized in a foundation system that integrates specifically configured brackets with load structure and applies elongated high tensile strength piles through the brackets at predetermined angles. These piles substantially engage the surrounding soil, thus, providing a high level of lateral, lift and bearing support. The brackets include selectively arranged elliptical openings that permit pile-lock upon installation, insuring a highly stable foundation. The system and method of its application further avoids the need for cementitious supporting materials while maintaining load bearing characteristics.

In the varying aspects of the present invention, use of timber structural elements are optionally implemented where dictated by load parameters and soil conditions. The level of lift, bearing and lateral support is defined by the number and length of the piles, the pile strength and the relative angles of the piles to the various load forces. In this way, a foundation can be designed and installed with minimal soil surface intrusion while providing significant support to the structure.

The foregoing features of the present invention may be better appreciated from the following detailed description of a specific illustrative embodiment thereof, presented in conjunction with the accompanying drawings:

DESCRIPTION OF THE DRAWINGS

FIG. 2 is a front view of a variation of the brackets in FIG. 1;

FIG. 3 is a perspective view of a variation of one of the brackets in FIG. 1;

FIG. 4 is a perspective view of a variation of the brackets in FIG. 2;

DETAILED DESCRIPTION OF THE PRESENT INVENTION

First, briefly in overview, the present invention is directed to a series of related structural devices that transfer the loads of surface structures to the earth, and are applicable for a wide range of loading conditions and to a wide range of surface structures. These devices are installed from above ground without the need for extensive site excavation or the use of cementitious materials. In the following discussion of the drawings, like numerals are used to indicate common elements provided in the various views.

Figure 1:
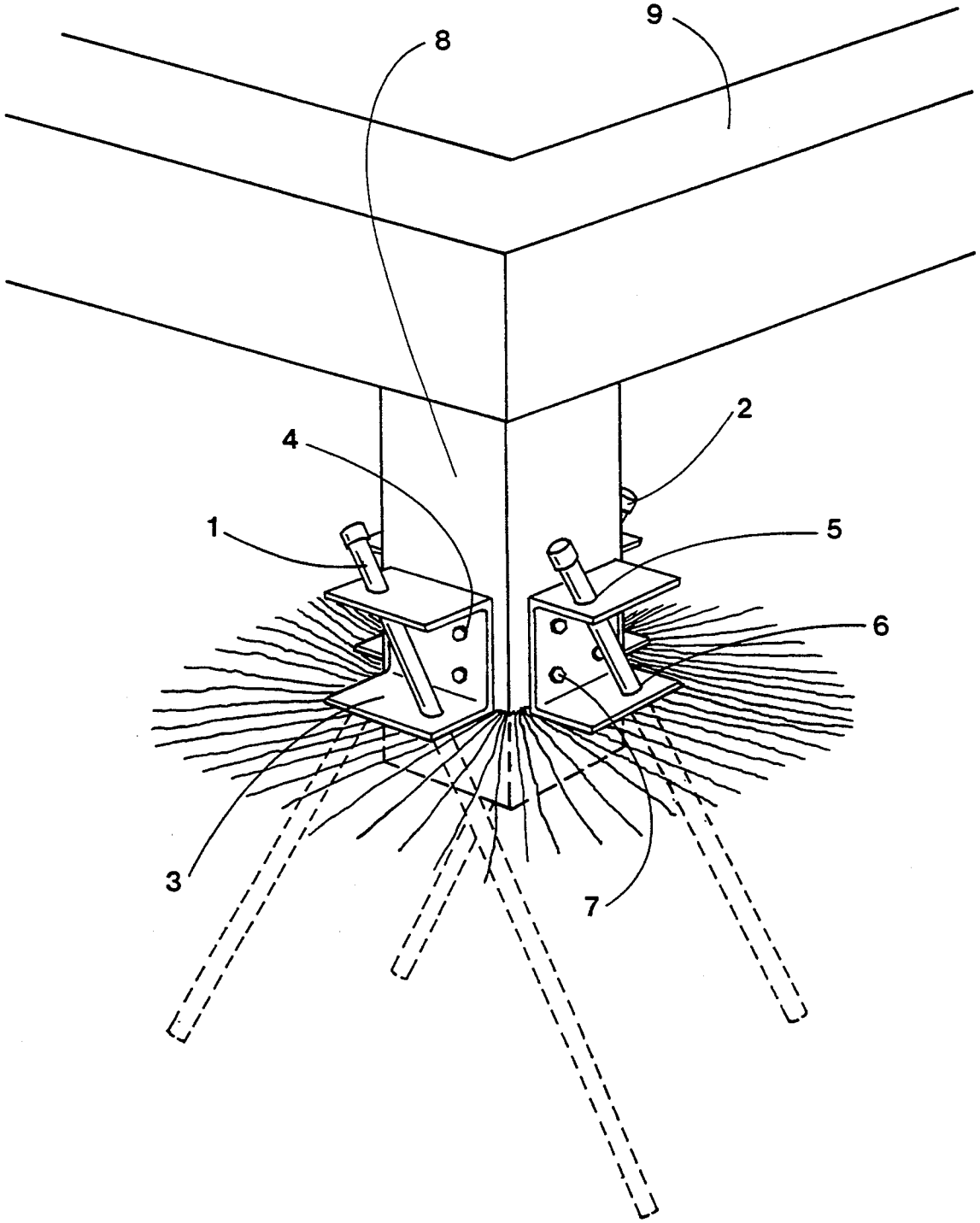
FIG. 1 is a perspective view of the preferred "bracket" embodiments attached to a vertical post (point load)

Referring now to FIG. 1, in a device resisting concentrated loads, U-shaped brackets 3 are attached with bolts 7 through attachment holes 4 to a surface structure post 8, a short distance above the base of the post, and on each of its four sides. Driven piles 1, each of a specific and typically similar length, pass through offset, upper and lower, elliptical driving holes 5 and 6 respectively, at each of the four attached brackets, and into the surrounding soil.

Each driven pile 1 is at a similar angle with respect to each other, and in relationship to the surface structure post. This angle corresponds to the eccentricity of the upper and lower, elliptical driving holes and is spaced to allow the driven piles to pass through them with minimal clearance and zero play. Each of the piles is capped with a tight fitting cap 2. The base of the surface structure post is positioned minimally within the surrounding soil and the bases of the bottom brackets are resting on the soil surface.

Such bracket, pile and post configurations may be used as isolated, independent surface structures or used in combination with a plurality of said configurations in support of a surface structure bearing beam 9, as depicted.

The application of surface structure loads to the bracket/pile configuration forces the circumferential edges of the upper and lower elliptical driving holes into firm contact with the surface of the driven piles where they pass through the holes, causing the brackets to bind or lock against the driven piles. This pile lock reaction transfers the structure loads to the piles, which in turn transfer the loads to the resisting soil.

The plane of the driving hole, that of the horizontal legs of the brackets 3, should be in some measure oblique, or canted, in relationship to the longitudinal axis of the driving pile, in order to achieve lock, and that the plane of the driving hole is in turn perpendicular to the direction of the primary loads. The preferred embodiment, as depicted in FIG. 1, is configured for use with bearing or uplift loads, as the planes of its driving holes are perpendicular to such vertical forces. Any resistance to lateral loads is a secondary function of the preferred embodiment since these loads will not cause the driving holes to lock substantially against the piles.

Within each bracket, a minimum of two driving holes, set a specific distance apart, are provided for each driven pile, to insure the proper driving angle of the pile and further to prevent the driven pile from moving laterally away from or toward the vertical axis of the surface structure post. More than two driving holes per pile may be provided with differing bracket shapes not shown. In general, additional driving holes will increase the lock on a given pile.

Though the preferred embodiment functions with four piles, a minimum of two or more piles placed in directly opposing orientations to each other relative to the surface structure post should be used, with their respective brackets, to function as a primary bearing/uplift device for concentrated loads.

Bracket pile lock, in the preferred embodiment, is achieved without tightening any of the parts of the assembly after the driving of the piles, but rather by simply loading the surface structure. As such, the degree of lock increases with any increase in load, and conversely relaxes with load removal.

Referring now to FIG. 2, the bracket 3 from FIG. 1 may be made up of two independent brackets 3*a* and 3*b*, capable of being slid right or left, or up or down, along slotted attachment holes 4*a* and 4*b*, respectively, to allow for variation of the degree of driving hole offset, both horizontally and vertically; thus, increasing or decreasing the degree of load required to lock the driven piles. This variation of the preferred embodiment allows for field adjustment in the event of premature binding during pile driving due to problematic soils, and/or allows the configuration to be tailored to specific loading conditions where, for instance, more surface structure resiliency, or a wider tolerance between the locked and relaxed modes of the device, might be required under prolonged dynamic loads.

Conversely, a smaller lock/relax tolerance might be required where lateral loads must be considered in addition to bearing and uplift loads. These tolerances may be set before loading, or adjusted afterward. A tighter tolerance would, unlike the preferred embodiment, cause the driving holes to lock against the piles under lateral loads. This embodiment can, therefore, be employed to resist a relatively equivalent combination of bearing, uplift and lateral forces.

Referring now to FIG. 3, in a condition where lateral loads are primary and vertical loads secondary, the bracket may be rotated 90 degrees relative to the axis of the surface structure post, orienting the planes of the driving holes 5 and 6 perpendicular to the lateral load and providing specifically locking resistance to lateral load. The bracket shape, depicted 3*c*, is a variation of the original embodiment bracket shape, in this case an H-shape, where two of the legs of the H extend substantially beyond the corners of the post 8 providing a stronger transfer of lateral load between the post and bracket. This configuration is not required, however, in order that the bracket resists primary lateral loads. The original U-shaped bracket of the preferred embodiment and/or its adjustable variation of FIG. 2, each turned 90 degrees, may be used. This embodiment is, therefore, to be used in conditions where lateral load considerations are primary. A minimum of one bracket and pile assembly may be used to resist lateral load.

FIG. 4 depicts a further variation on the adjustable, two-part bracket shown in FIG. 2. The two brackets hinge at a common attachment hole 4*c*. The upper bracket 3*c* is free to move a limited distance up or down relative to the common hinge point along a curved slot attachment hole 4*d*. A similar attachment hole 4*e* permits the elongated lower bracket 3*d* to move a limited distance right or left relative to the same hinge point at 4*c*. The lower bracket is also spaced the thickness of the upper bracket away from the surface structure post by means of a spacing washer 10 set between the lower bracket and post and centered to allow attachment bolts 7 to pass through the attachment hole 4*e*, through the spacing washer and into the post. The driving holes 5*a* and 6*a* are realigned accordingly.

This configuration provides driving hole planes perpendicular to both vertical and horizontal loads, creating bracket resistance equally for bearing and lateral loading. It does not, however, substantially resist uplift loads, as such a force on the surface structure will not force the bracket driving holes into lock against the driven piles due to the hinging nature of the brackets. This hinging characteristic, of all the embodiments, provides the most resilient, or flexible, system under changing or dynamic loads. If the hinging aspect, which provides for surface structure resiliency under changing or dynamic loads, is sacrificed, by using the standard round attachment holes 4 as in the preferred embodiment, and eliminating the overlap of the brackets and the resulting spacer and driving hole realignment, so that the brackets are secured in place before or after loading, this configuration will be able to resist uplift forces in addition to lateral and bearing loads.

Figure 5:
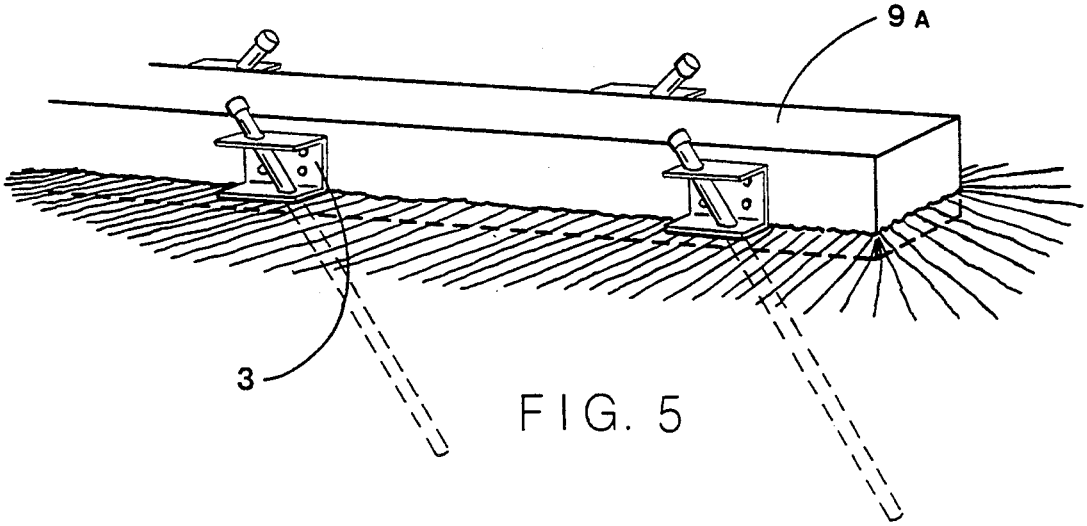
FIG. 5 is a perspective view of the preferred bracket embodiments attached to a horizontal beam.

Referring now to FIG. 5, the preferred embodiments may be attached directly, in a continuous or alternating linear fashion, at specific appropriate intervals, and on either side, of a surface structure bearing beam 9*a*, laid into the ground a shallow distance, such that the bases of the preferred embodiment brackets 3 are resting against said ground, providing in the resisting soil, a primary bearing and uplift device for evenly, and unevenly, distributed loads. All of the configuration variations, FIGS. 2, 3 and 4, and the preferred embodiment in FIG. 1, may be used homogeneously or in combination in such a linear fashion to provide resistances against evenly or unevenly distributed loads such as those borne by the bearing beam 9*a* at grade.

Figure 6:
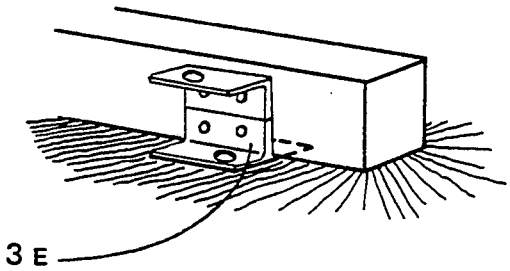
FIG. 6 is a perspective view of a variation of the adjustable two-part bracket in FIG. 2.

Referring now to FIG. 6, a variation of the adjustable two-part bracket, depicted in FIG. 2. It provides a T-shaped bottom bracket 3*e* which acts to improve the transfer of specifically bearing loads from the grade beam to the bracket and pile. In this configuration, the lower portion of the beam is not within the soil, but resting on top of it.

Figure 7:
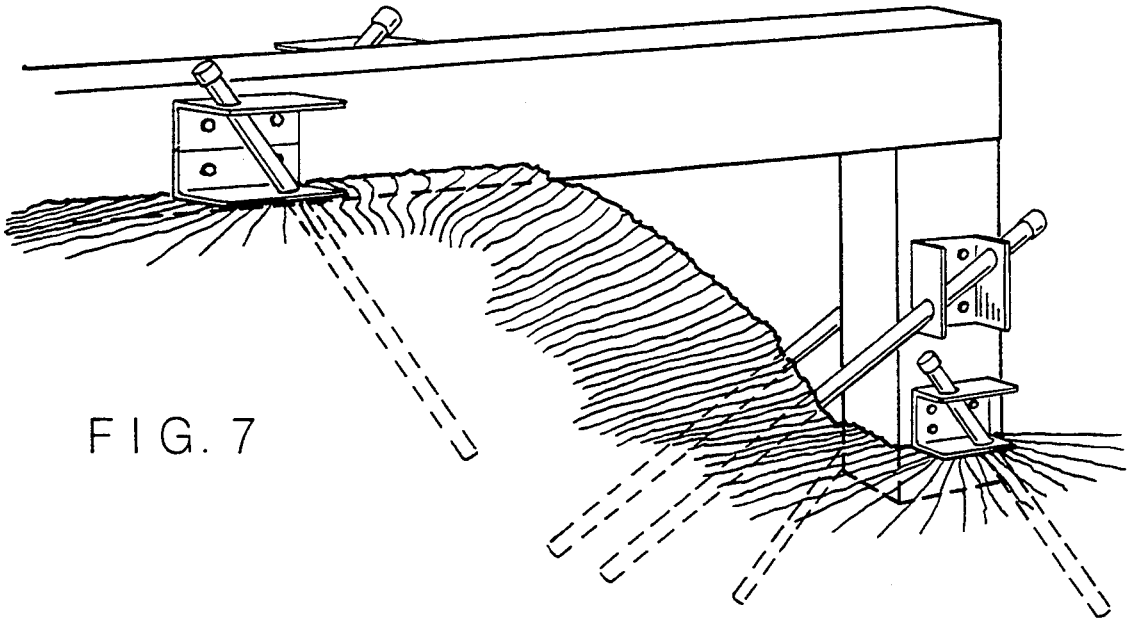
FIG. 7 is a perspective view of a combination of bracket embodiments attached at differing locations to a vertical post or horizontal grade beam.

Referring now to FIG. 7, the versatility of the bracket allows for its attachment at varying heights around the surface structure post, or in multiple positions along the surface structure grade beam. Brackets can be installed above or below each other, and combinations of variations may be used together. Specific load requirements might also necessitate the asymmetrical attachment of brackets to either a post or beam and certain configurations can accommodate this need. All bracket variations are removable and maintainable from above ground.

The surface structure members in FIG. 7, and the surface structure post (FIGS. 1–4) or grade beam (FIGS. 5 and 6) to which various bracket embodiments are attached, is comprised of wood suitably treated to resist decay and insects as conditions require. Other materials may be substituted provided that the buildability of the completed surface structure is not sacrificed, and the flexibility of the bracket to be attached in various configurations to differing surface structure members and to resist various types of loading forces can be maintained.

Figure 8:
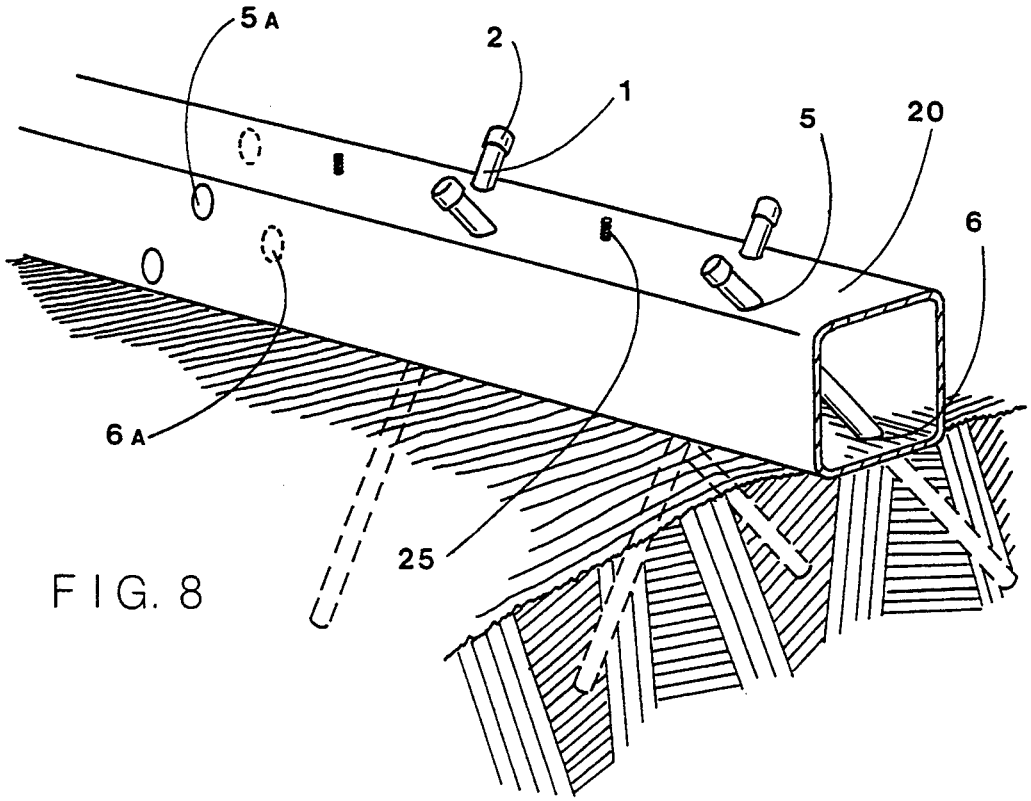
FIG. 8 is a perspective view of the preferred embodiment of the horizontal integral component system.

Referring now to FIG. 8, where appropriate integral surface structure members 20 may be designed and adapted to receive a plurality of relatively short, obliquely driven piles 1, through upper and lower elliptical driving holes 5 and 6, formed, bored or punched into the integral structural member during manufacture or on site. The driven piles 1 are capped with tight fitting caps 2. The base of the integral member is positioned minimally within the surrounding soil, and is resting on it. The integral member may stand alone as a complete structure, or an ensuing structure may be connected to the integral member by the conventional attachment means 25 shown, or by any other conventional means.

In this situation, the attaching of brackets to the surface structure, as depicted in FIGS. 1–7, is unnecessary, as the driving/locking holes of those brackets are made an intrinsic part of the surface structure member. This embodiment is configured for response to bearing and uplift loads, as the planes of its driving holes are oriented perpendicular to the axis of these loads. Holes 5*a* and 6*a* demonstrate the option of adding lateral resistance to the capacity of the integral member by orienting some driving holes with their planes perpendicular to a typical lateral force. All the holes may be oriented for lateral resistance rather than for bearing and uplift, and, as in FIG. 7, a more complex variety, and/or combination, of loads may be resisted by combining driving holes of differing orientation and placement.

Figure 9:
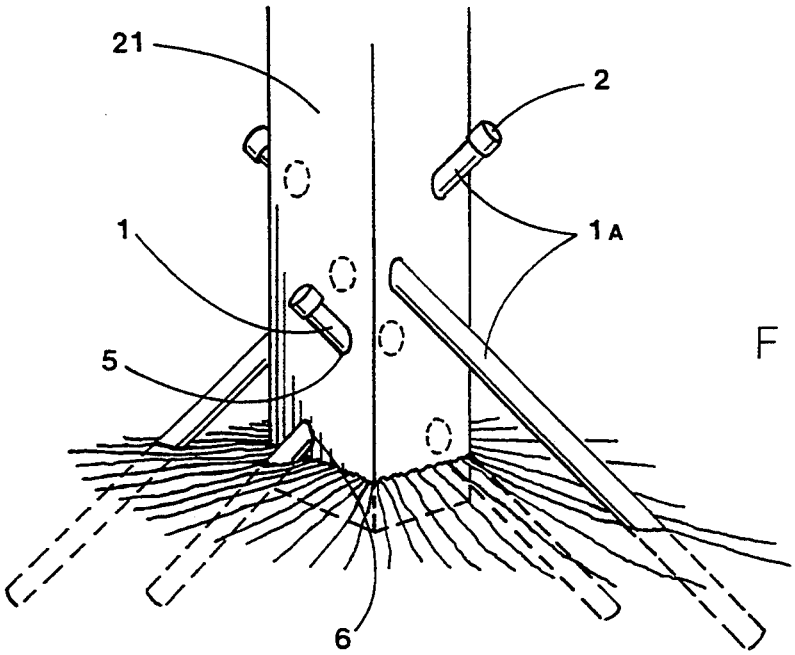
FIG. 9 is a perspective view of a vertical integral component.

Referring now to FIG. 9, the integral structural member 21, may stand vertically, with its upper and lower driving holes 5 and 6 substantially near one end of the member, in this case a structural column. The end of the integral member is set minimally within the surrounding soil a specific distance. There may be two or more driven piles 1 at the base of a given integral member, and there may be additional groupings of driven piles 1*a* above those closest to the surrounding soil. The piles are capped with tight fitting caps 2. This configuration will resist primarily lateral loads, as the planes of the driving holes are perpendicular to the axes of typical lateral forces. This configuration will also resist bearing and uplift loads, but only secondarily as these forces will not cause the driving holes to bind against the driven piles and create lock.

Figure 10:
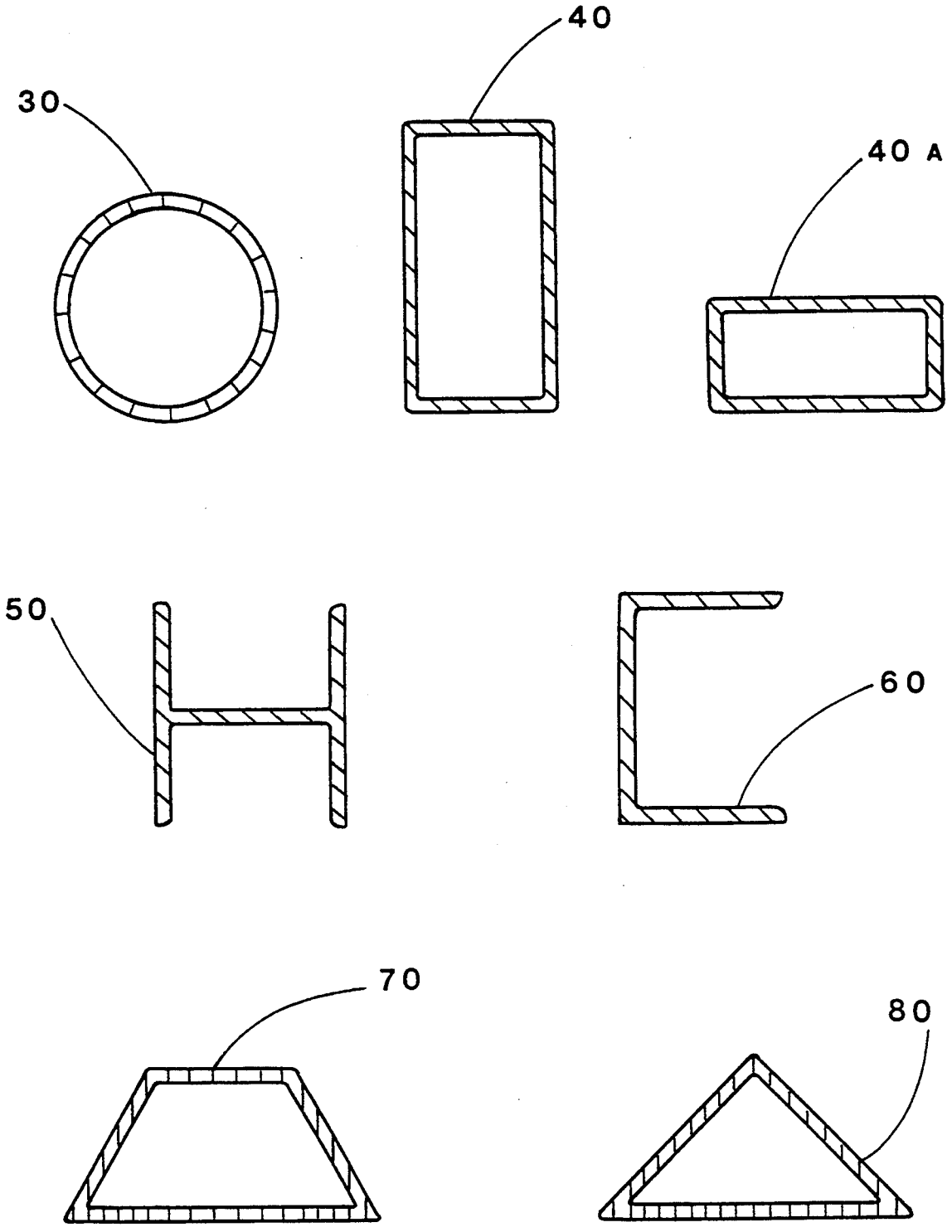
FIG. 10 is a series of possible integral component cross sections which can be used either horizontally or vertically.

Referring now to FIG. 10, there are a variety of integral member shapes, oriented either horizontally or vertically, which may be suitably adapted to accept relatively short, obliquely driven piles, of specific and substantially similar length to create surface structure to earth, load transfer systems. Section shapes may be circular 30, rectangular 40, and rectangular turned 90 degrees 40*a*, or the sections may be H-shaped 50, U-shaped 60, trapezoidal 70, or triangular 80. The possible range of geometries and section shapes which may be employed without sacrificing the intended function of the integral structure member embodiment is not limited to those shown.

As with all system configurations, these shapes may be utilized to resist differing combinations of loads, and as integral members in a variety of surface structure types.

Differing system configurations, soil conditions and structural functions dictate, in addition to specific angular relationships between the piles and the surface structure members, their respective sizes. In general, increasing the diameter of and number of supportive piles increases their specific load resistance, as does increasing the surface area of that part of the surface structure member in contact with the soil. However, both the attached bracket and integral structure member embodiments can be installed such that the vertical or horizontal members engaged in the transfer of load do not touch the soil at all, but are instead perched above it, supported by the driven piles. The additional load resistances transferred directly from the structural member to the soil where the two are in contact is lost, but other advantages such as avoiding the potential for the rotting or corrosion of the surface member are gained.

The brackets 3 and 3*a–e* in FIGS. 1–7, and the integral surface structure components 20, 21, 30, 40, 40*a*, 50, 60 and 70 are galvanized steel, but may be of any appropriate material which possesses the necessary strength and characteristics required to function in adequately transferring specific loads from the structure to the driven piles, and to sufficiently lock those driven piles under load. Corrosive protection such as galvanizing may be substituted by any number of appropriate coatings or alternative protection methods, or may not be necessary when said brackets or integral structure members are made of certain non-corrosive materials. In some instances, such as temporary installations, or the use of the configuration in certain specific environments, corrosion protection may not be required. Similarly, bolts 7 in all applicable embodiments are galvanized metal but may be of differing materials and/or of differing fastening styles as appropriate.

The piles 1 in the preferred embodiment, and all subsequent embodiments, are of thick walled galvanized steel pipe, but may be of any suitable material provided that (a) they develop the necessary resistance in specific surrounding soils, (b) are of such a composition, or are coated with such a composition, that, if necessary, they resist corrosion, (c) they can be driven without suffering significant structural failure or degradation, (d) they can be suitably engaged by the locking effect of the offset driving holes of the bracket assembly or integral structure member and (e) they are of a uniform cross-section, allowing again for the adequate locking effect of appropriately matched, offset driving hole shapes. All the piles in all the figures disclosed, and in those variations of the art not specifically depicted, can be extracted and replaced due to corrosion or other mode of failure, or they can be extracted without being replaced in order that the supported structure be entirely removed.

The caps 2 are made of rigid thermo-plastic, and are provided to prevent contaminants, such as rainwater, from entering the otherwise exposed open end of the driven pipe piles. These caps may likewise be substituted by any number of similar materials, or may be eliminated depending on the material and/or cross-section of the driven piles.

The angle of the piles 1 in the preferred embodiment is approximately 60 degrees with respect to the horizontal surface of the soil, and the piles are installed angled left to right. This may be reversed, provided piles on adjacent post faces, piles adjacent to each other on horizontal beam faces or piles engaged in the same integral structure member will not interfere with each other above or below the soil. Also, the 60 degree angle may be reconfigured in the range from 25 to 75 degrees depending upon the soil conditions and loading requirements, provided that driving hole plane to specific load path relationships are maintained, bracket to pile, or integral structure member to pile, lock relationships are maintained, and/or versatile bracket to various surface structure relationships, and integral structure member to ensuing surface structure relationships are maintained.

EXAMPLE

A further understanding of the benefits of the present invention can be reached in the context of the following example. The construction of an elevated wooden walkway through a wooded wetlands park would typically require the removal of considerable trees, brush and vegetation, with the use of large, driven construction equipment likely to have difficulty working its way in through soft, wet soils and causing considerable site damage and erosion. Considerable cost would have to be spent both in attempts to preserve the existing environment from the effects of this equipment, and to repair the environment following construction.

The typical support system for such a walkway would be a series of wooden posts, grouped in pairs and spaced in appropriate increments along and beneath the walkway platform. In reasonably strong soils, the posts would be set in an augured hole, four to six feet deep and one and a half times the diameter or width of the post. Concrete or compacted gravel would be used to refill the hole after the setting of the post. In weaker soils, large pile driving equipment would be driven into the site, over each post position and the posts would be pile driven until they reached a specified resistance, typically at a depth of more than ten feet and often higher. With all the posts set, using either of these installation methods, the final height of the walkway would be sighted, the posts cut off at the appropriate height above the ground, and the construction of the walkway begun.

Use of the present invention would eliminate the need for excessive clearing, the use of large, environmentally damaging equipment, the use of concrete or gravel, and the need to set all posts before beginning the construction of the walkway platform. The course that the walkway would follow would be cleared essentially only as wide as the walkway itself, rather than a width required for driven construction equipment, and only those areas of the ground upon which posts were to be set would have ground vegetation removed. Fallen trees and low brush or grasses in the areas between supporting posts would be left intact. The height of the walkway would at this point be sighted and the heights of supporting posts determined. The posts would be cut to length in a more controlled environment such as a shop, and sets of brackets such as those in FIG. 1 would be attached to the posts on four sides at one end, roughly 4 inches above the post base.

The posts would then be carried out to the site or wheeled in a small cart to the beginning of the walkway. A shallow hole, 4 inches deep, corresponding to the distance between the bottom of the attached brackets and the base of a given post would be dug, and the post stood upright in this hole with the bottoms of the brackets resting on the soil surrounding the hole. Driving piles 5 feet long and $1\frac{1}{2}$ inches in diameter would be passed through the upper and lower driving holes of each successive bracket around the circumference of the post, and tapped a few inches into the soil with a sledge hammer. Provided the post is properly positioned and held plumb, the piles would be driven in succession into the soil their full length, or in 1 to 2 foot increments, until the upper ends of the piles are approximately 3 inches above the tops of their respective brackets. The upper end of the pile would be checked for any driving deformation, corrected if necessary, and capped. The piles may be driven with a sledge hammer as human fatigue and the strength of the soil allows, or they may be driven with a hand-held pneumatic hammer.

Two successive groups of posts may be erected in this fashion, and the construction of the walkway platform may be started. Additional materials for the erection or supporting posts may be wheeled out to the end of the newly constructed walkway instead of traveling back and forth over the natural environment. As the construction of the walkway continues, its weight creates a bearing load on the bracket and pile assemblies, forcing the driving holes into contact with the sides of the piles and causing lock, transferring the bearing forces of the walkway to the piles and into the supporting soils.

At either end of the walkway, where a ramp would typically rise from grade to the height of the elevated section, the present invention would be employed, as in FIG. 5, to provide a ground level support beam at grade, at the lower ramp ends, perpendicular to the long axis of the walkway. At selected locations along the length of the walkway, additional brackets and piles, as in FIG. 3, would be placed on specific posts above the previously attached brackets to provide lateral resistance in order to restrict the tendency of the walkway to shift back and forth during use.

In the typical construction method, if a post begins to decay a few inches below the ground surface, or is damaged in some other way, it cannot typically be removed without considerable dismantling of the walkway platform, or considerable excavation. A replacement post must, therefore, be set adjacent to the existing, in an unsightly and structurally inconsistent position, still requiring difficult excavation, walkway removal and repair for the installation.

The present invention can be entirely maintained from above ground. For this example structure, only the walkway decking would have to be removed in order to access the driven piles if they began to fail due to excessive corrosion and had to be removed and replaced. It would only be necessary to temporarily relieve the load on the bracket and pile assemblies by jacking up the walkway platform slightly, and the pile could be extracted with a simple winch. Similarly, if the post base begins to decay and must be replaced, after jacking up the walkway slightly, bracket bolts on the decaying post could be removed, with the piles left in place, a new post positioned exactly as the original, and the brackets reattached.

It is to be understood that the present invention has applications aside from the example application specifically described. The above-described arrangement is merely illustrative of the principles of the present invention. Numerous modifications and adaptations thereof will be readily apparent to those skilled in the art without departing from the spirit and scope of the present invention.

What is claimed is:

1. A load bearing system for supporting surface structures in earthen environments having a plurality of load condition characteristics, comprising:

an integrated surface structure subjected to one or more load characteristics including lateral, bearing, and uplift type loads;

a plurality of elongated piles characterized by high levels of tensile strength and stiffness;

a pile to structure attachment means for rigidly attaching said pile to said surface structure at a predetermined angular relationship, wherein said pile to structure attachment means includes pile guide openings arranged to define a pre-determined angular relationship, said openings further formed in offset parallel planes each having openings positioned in an offset relationship; in an unloaded condition while driving said piles into said earthen environments, said relationship allowing minimal clearance with near zero play upon sliding engagement of said piles with said openings; and upon leading said surface structure creating a dynamic lock between said attachment means and said piles with binding engagement therebetween;

at least one of said pile to structure attachment means including first and second brackets slidably disposed relative to one another, each bracket having at least one pile guide opening extending through one surface thereof and a second surface including means for attaching said bracket to said surface structure;

at least one of said first and second brackets including a surface attachment means which provides sliding adjustment of said bracket in at least one direction relative to said surface structure, at least one of said pile guide openings being moveable relative to that of another of said openings to permit change of said offset relationship of said openings, whereupon variation of said relationship accommodates the application of variable loads upon said dynamic locking.

2. The system of claim 1 wherein said piles have a substantially circular cross-section and said openings are elliptical with an eccentricity corresponding to the angularity of said piles in relationship to said structure load conditions.

3. The system of claim 2 wherein said first and second brackets include plural, substantially orthogonal surfaces.

4. The system of claim 3 wherein at least one of said brackets include a third surface substantially parallel to said first surface and having a second pile guide opening offset from said pile guide opening on said first surface thereby defining said angular relationship between said piles and said surface structure.

5. The system of claim 1 wherein said surface structure contacts and rests on said earthen environment.

6. The system of claim 1 wherein said surface structure includes portions thereof that extend into said earthen environment.

7. The method of forming an integrated non-intrusive foundation system for the stabilization of a surface structure, characterized by one or more lead parameters, comprising the steps of:

attaching to said surface structure a structure to pile connection means wherein said connection means includes at least two pile guide openings arranged to define an acute angle, wherein at least two openings correspond to a single pile; said openings further formed in offset parallel planes each having openings positioned in an offset relationship;

in an unloaded condition while driving one or more elongated rigid piles through said two openings and into said ground, said offset relationship allowing minimal clearance with near zero play upon sliding engagement of said piles with said openings, said piles having a high level of tensile strength and being long relative to said connection means;

locking dynamically said piles at a pre-defined angular relationship to said surface structure upon loading said surface structure, said dynamic locking being effected between said attachment means and said piles with binding engagement therebetween; and to accommodate change of said loading, adjusting at least one of said pile guide openings relative to another to change their offset relationship and hence the clearance between said attachment means and said piles for binding engagement therebetween upon said changed loading.

8. The method of claim 7, wherein said pile guide openings are elliptical in shape corresponding to the diameter of said piles and the angular offset.

9. A load bearing system for supporting surface structures in earthen environments having a plurality of load condition characteristics, comprising:

an integrated surface structure subjected to one or more load characteristics including lateral, bearing, and uplift type loads;

a plurality of elongated piles characterized by high levels of tensile strength and stiffness;

a pile to structure attachment means for rigidly attaching said pile to said surface structure at a predetermined angular relationship, wherein said pile to structure attachment means includes pile guide openings arranged to define a pre-determined angular relationship, said openings further formed in offset parallel planes each having openings positioned in an offset relationship; in an unloaded condition while driving said piles into said earthen environments, said relationship allowing minimal clearance with near zero play upon sliding engagement of said plies with said openings; and upon loading said surface structure creating a dynamic lock between said attachment means and said piles with binding engagement therebetween;

at least one of said pile to structure attachment means including first and second brackets hingedly connected relative to one another, each bracket having at least one pile guide opening extending through one surface thereof and a second surface including means for attaching said bracket to the surface structure;

at least one of said first and second brackets including a surface attachment means which provides sliding adjustment of said bracket in at least one direction relative to said surface structure, at least one of said pile guide openings being moveable about said hinged connection, relative to that of another of said openings, to permit change of said offset relationship of said openings, whereupon variation of said relationship accommodates said dynamic locking upon application of a dynamic lead.

* * * * *